US007870775B2

(12) United States Patent
Höfer et al.

(10) Patent No.: US 7,870,775 B2
(45) Date of Patent: Jan. 18, 2011

(54) DRIVE ARRANGEMENT FOR ROLLING MILL

(75) Inventors: Günter Höfer, Hilchenbach (DE); Volker Braas, Freudenberg (DE); Michael Lipowski, Seck (DE); Heinz-Adolf Müller, Wilnsdorf (DE); Peter Brandenfels, Hilchenbach (DE); Joachim Hafer, Siegen (DE); Christof Klein, Kreuztal (DE); Christoph Sundermann, Hilchenbach (DE); Stefan Krämer, Hilchenbach (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 336 days.

(21) Appl. No.: 11/991,119

(22) PCT Filed: Sep. 4, 2006

(86) PCT No.: PCT/EP2006/008595

§ 371 (c)(1),
(2), (4) Date: Feb. 27, 2008

(87) PCT Pub. No.: WO2007/033757

PCT Pub. Date: Mar. 29, 2007

(65) Prior Publication Data

US 2009/0049883 A1 Feb. 26, 2009

(30) Foreign Application Priority Data

Sep. 21, 2005 (DE) ..... 10 2005 045 201
Jul. 25, 2006 (DE) ..... 10 2006 034 217

(51) Int. Cl.
*B21B 31/07* (2006.01)

(52) U.S. Cl. ..... 72/249; 72/449

(58) Field of Classification Search ..... 72/237, 72/249, 449

See application file for complete search history.

(56) References Cited

U.S. PATENT DOCUMENTS

| | | | | |
|---|---|---|---|---|
| 3,129,618 | A * | 4/1964 | Hergeth | 72/224 |
| 3,347,308 | A * | 10/1967 | Saunders | 164/420 |
| 4,024,746 | A * | 5/1977 | Bruck | 72/249 |
| 4,037,452 | A * | 7/1977 | Grimpe et al. | 72/249 |
| 4,182,149 | A * | 1/1980 | Wilson | 72/244 |
| 4,807,458 | A * | 2/1989 | Buch et al. | 72/235 |
| 5,761,945 | A * | 6/1998 | Vandenbroucke | 72/176 |

FOREIGN PATENT DOCUMENTS

| | | |
|---|---|---|
| DE | 699 121 | 11/1940 |
| DE | 924 983 | 3/1955 |
| DE | 12 52 612 | 10/1967 |
| DE | 44 08 289 | 9/1995 |
| DE | 694 11 580 | 3/1999 |
| DE | 199 11 751 | 6/2000 |
| EP | 0 287 674 | 10/1988 |
| GB | 358 291 | 10/1931 |
| JP | 60 108108 | 6/1985 |

* cited by examiner

*Primary Examiner*—Edward Tolan
(74) *Attorney, Agent, or Firm*—Lucas & Mercanti, LLP; Klaus P. Stoffel

(57) ABSTRACT

In the case of a drive arrangement for a rolling mill, comprising at least one drive motor (M), a main gear mechanism (HG), a pinion gear mechanism (KWG), a rolling stand (G) with working rolls (AW), and the spindles, couplings and the like which connect these components, the main gear mechanism (HG) is a single-stage one and the drive axis (AN) is spaced apart from the output axis (AB) by an upwardly directed, vertical spacing (vA).

4 Claims, 5 Drawing Sheets hA
W
HG c
c
AN
F
AB c - c
PRIOR ART
AN
AB

DRIVE ARRANGEMENT FOR ROLLING MILL

The invention concerns a drive arrangement for a rolling mill, which consists of at least one drive motor, a main gearbox, a pinion gear unit, a mill stand with work rolls, and the couplings, spindles, and the like that connect these components, where, in the main gearbox, a drive shaft and a driven shaft are separated by a horizontal distance.

In this connection, the drive motors, main gearboxes, pinion gear units, and mill stands are constructed and mounted on a common foundation or on several individual foundations. The structure and design of the foundations depends, among other things, on the weights of the specified components and on the torques to be transmitted.

German Late Disclosure DE 1 252 612 discloses a drive arrangement with a common drive motor for two mill stands with an offset arrangement that can be operated on different pass lines. A gear reducer and one stationary pinion stand each at the distance of the universal joint shaft from the stand locations are additionally assigned to the drive motor. The two drivetrains in front of the pinion stands can be disconnected by two clutches, and their offset distance is adjusted by intermediate gear wheels in the gear reducer, while the direction of rotation is maintained. In this connection, the mill stand location has an offset distance with the pinion stand closest to the gear reducer, which offset distance is greater than the width of two mill stands.

The technical report on continuous casting and rolling plants, "Rolling Continuously Cast Near-Net Strips", Reprint from Stahl und Eisen (Verlag Stahleisen, Düsseldorf), 108 (1988), No. 3, pp. 25-35, authors: G. Fleming, P. Kappes, W. Rohde, and L. Vogtmann, describes a CSP rolling mill. A plant plan of a CSP plant is shown on p. 9, FIG. 25, in which a rolling mill is labeled with reference number 4.

A rolling mill with the main components, such as motors, gearboxes, mill stands, rolls, etc., is known from the technical report on hot strip and cold strip production, "Rolling Mill Expansion at Alcan Aluminio do Brasil", Reprint from Light Metal Age 1999, No. 6, pp. 8-13, and Metallurgical Plant Technology, Vol. 22 (1999), No. 6, pp. 38-44, authors: R. M. Rocha, K. A. Gdovka, and S. T. Kerbaugh.

DE 199 11 751 C1 describes a drive arrangement for a mill stand with two work rolls, where the drive arrangement has a gearbox with two toothed rollers, each of which can be coupled with a work roll of the mill stand. The toothed rollers have different numbers of teeth.

Drive arrangements for rolling mills that consist of at least a motor and a gearbox are also known from DE 699 121, DE 924 983, DE 44 08 289 A1, and DE 694 11 580 T2.

Previously known rolling mills are designed for a specific type of rolling (hot rolling/cold rolling) and for predetermined characteristics of the rolled product. In other words, existing plants can be loaded or utilized only up to a limit established far in advance.

In order to increase production quantities, to improve the quality of the products, to be able to produce smaller final thicknesses, and to be able to produce new products (steel grades), it is necessary to achieve a significant increase in the power or torque and draft, especially in the first mill stands.

In existing plants, there is the problem that reconstruction or modernization is only possible if the downtimes are minimal. Therefore, large-scale foundation work is out of the question. Due to the fact that the foundations cannot be changed, significantly higher torques must be transmitted in the same area in drive motors, main gearboxes, pinion gear units, gear-type spindles, and the work rolls. Due to the existing foundations that cannot be changed, the horizontal distance between the drive shaft and the driven shaft, which lie in one plane in previously known main gearboxes (see FIGS. 2 and 3), cannot be diminished or increased.

Therefore, the objective of the invention is to improve a drive arrangement of the aforementioned type in such a way that the disadvantages and problems indicated above are eliminated.

In accordance with the invention, this objective is achieved by designing the drive shaft in the main gearbox as a single-stage gearbox, and the drive shaft is constructed with an upwardly directed vertical distance from the driven shaft. In this way, the horizontal distance between the shafts remains the same, but the spatial separation can be increased in order, for example, to allow for larger shaft diameters, larger gear wheel diameters, etc.

In a refinement of the invention, the main gearbox has a multistage design, i.e., it has at least two stages. In special applications, three-stage or four-stage designs are also possible. As the result of a multistage design of the main gearbox, the horizontal separation of the drive shaft and driven shaft is arranged identically before and after the reconstruction, even if a higher torque is transmitted.

By increasing the gear ratio compared to the original state, sometimes even the drive motor can be kept.

In the case of a pinion gear unit, it is usually possible, by means of the shaft separation, to achieve an increase in torque that is neutral with respect to the space requirements.

In the case of the gear-type spindles, larger diameters can be used, because work rolls with larger diameters are used in the stand.

The main gearbox is designed in such a way that the horizontal distance between the shafts remains identical. A vertical shift of the drive shaft in the upward direction is possible, since a displacement of the drive motor on the existing foundation, which is not to be changed, in the vertical direction can be easily accomplished by a subframe.

The advantages of the drive arrangement of the invention are that the production quantities can be increased, the quality of the rolled product can be improved, smaller final thicknesses can be produced, and new products (steel grades) can be produced.

In accordance with the invention, the motors used in the existing rolling mill can continue to be used. However, it is also possible to use new motors.

In a special design, the vertical alignment of the motor can be accomplished by the use of underlays. Therefore, complicated foundation work is not necessary.

A specific embodiment of the invention is described in detail below with reference to schematic drawings.

FIG. 1 shows a top view of the components of a rolling mill W. A motor M transmits a torque to a main gearbox HG, which is connected with a pinion gear unit KWG, for example, by means of an "intermediate tube" coupling ZRK.

From the pinion gear unit, the work rolls AW of a mill stand G are driven by articulated gear-type spindles ZS.

Additional parallel drive arrangements are present at a distance I and drive additional mill stands G, which are installed at a distance g from the first mill stand G. The distance g between several mill stands G and the distance I between several drive arrangements can be the same or different.

Figure 1:
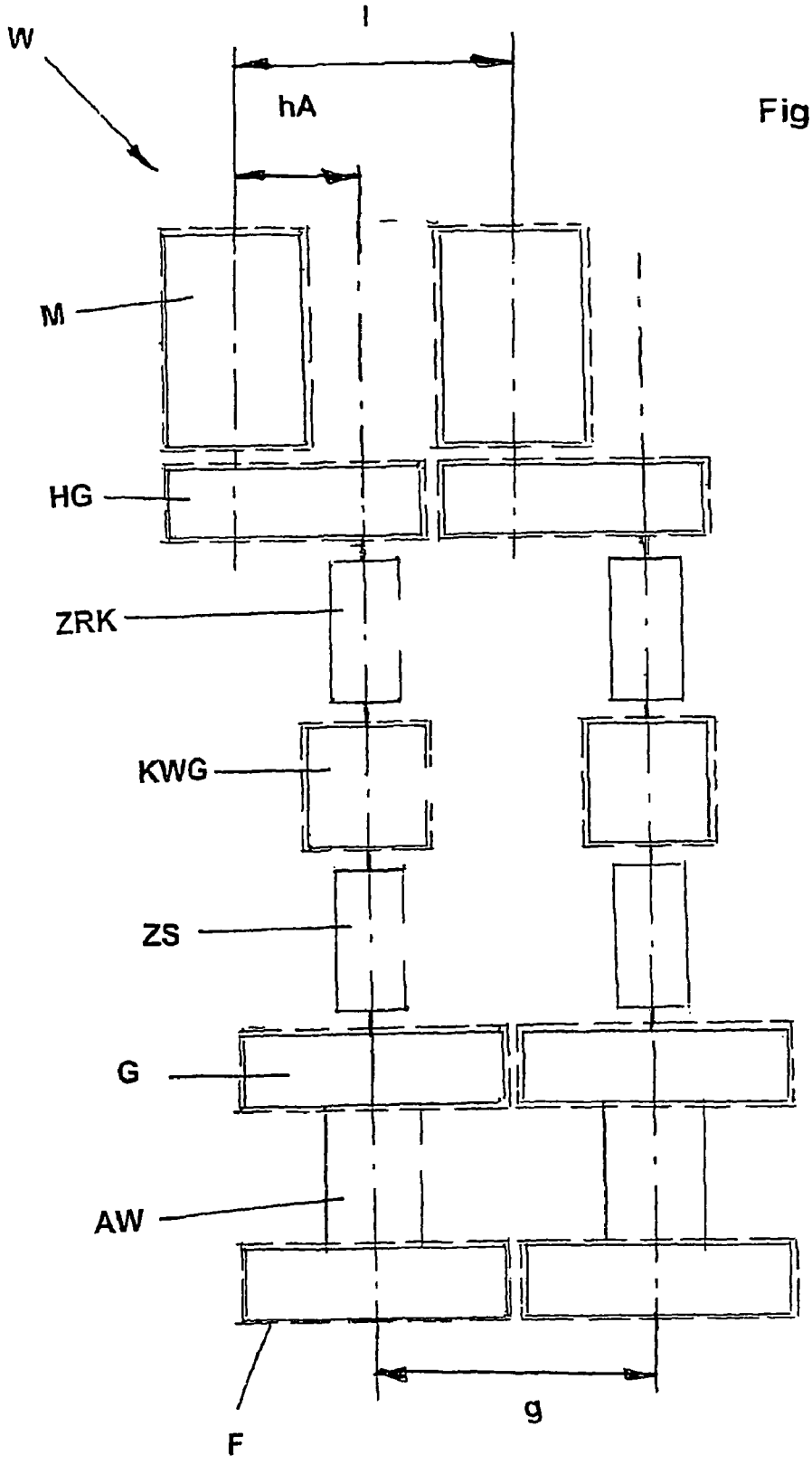
FIG. 1 shows a top view of the individual components of a rolling mill.
Figure 2:
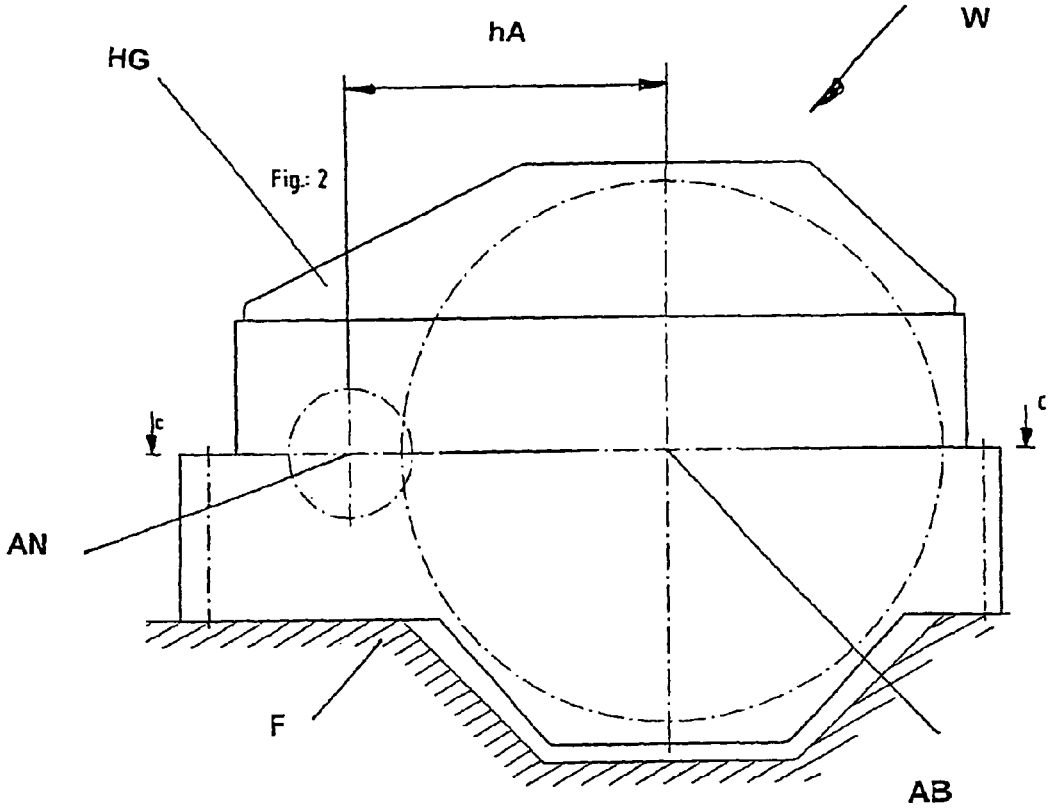
FIG. 2 shows a front elevation of a main gearbox according to the prior art.
Figure 3:
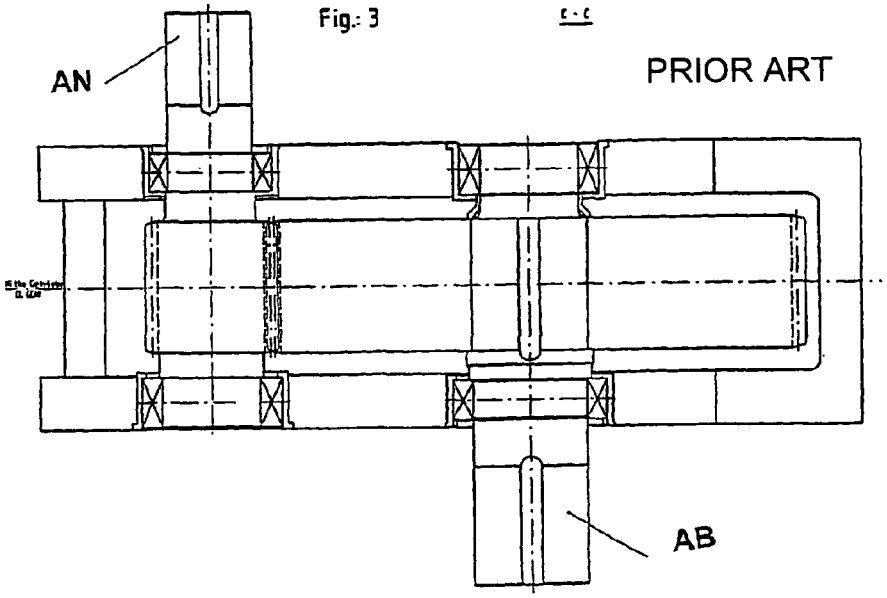
FIG. 3 shows a top sectional view of a previously known, single-stage main gearbox.

It is known from the prior art that the main gearbox HG can have a single-stage design. As FIGS. 2 and 3 show, a previously known main gearbox HG has a drive shaft AN and a driven shaft AB, which are connected with each other by an existing pair of gears. The main gearbox HG is mounted on a foundation F.

Figure 4:
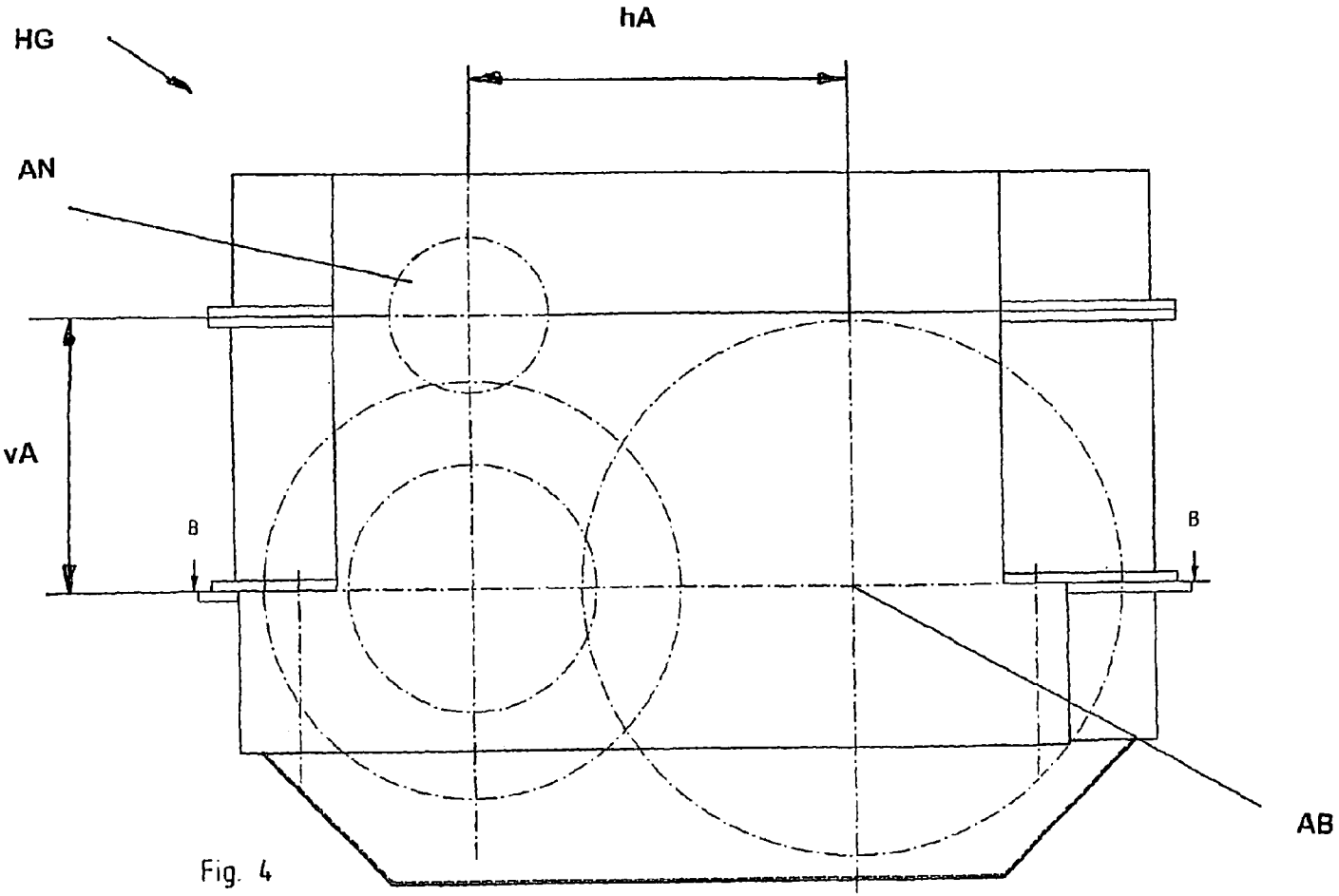
FIG. 4 shows a front elevation of a multistage main gearbox in accordance with the invention.
Figure 5:
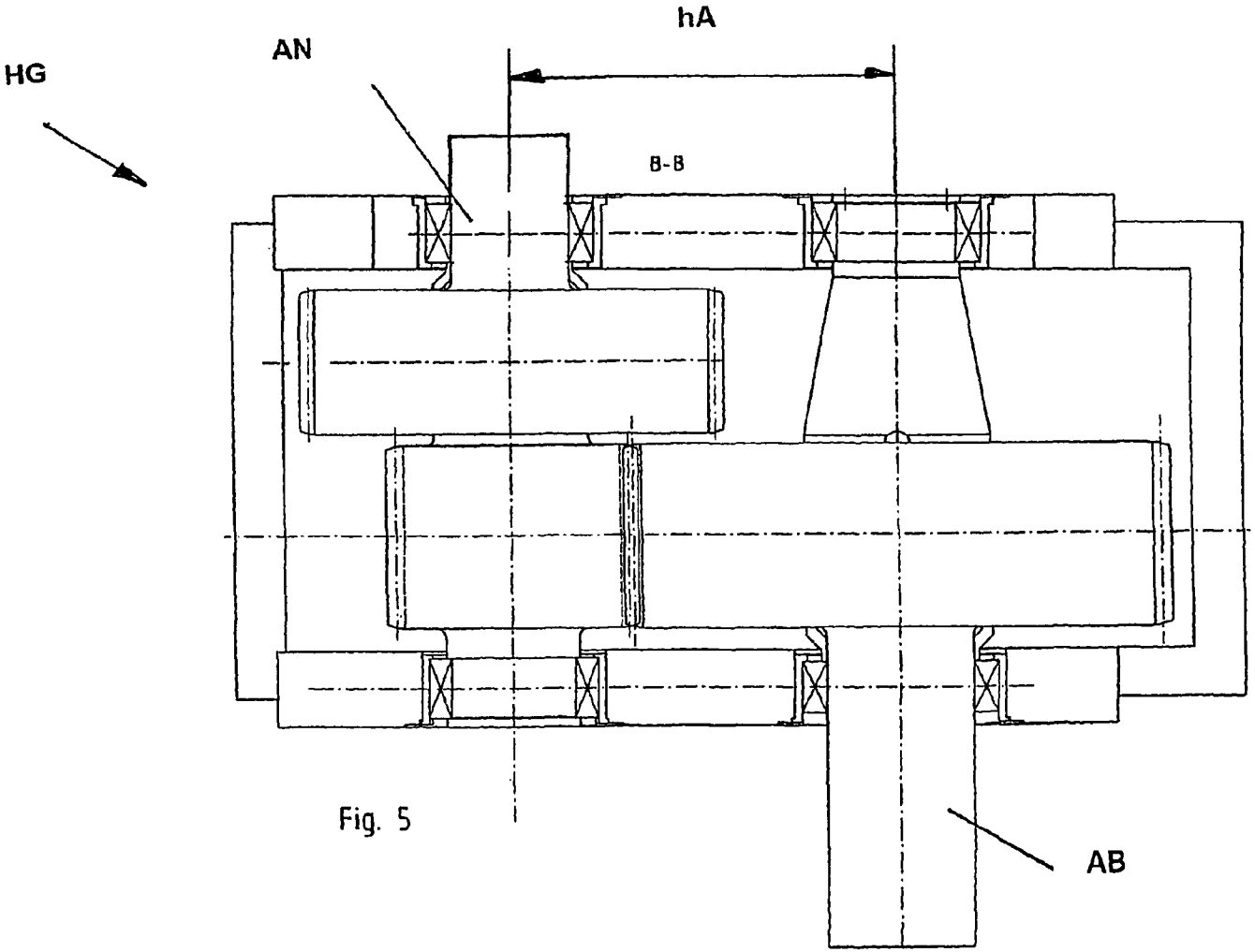
FIG. 5 shows a top sectional view of a two-stage main gearbox.

A modification in accordance with the design of the invention is shown in FIGS. 4 and 5, in which the drive shaft AN and the driven shaft AB of the main gearbox HG are connected with each other and transmit a torque by a pair of two-stage gears.

Figure 6:
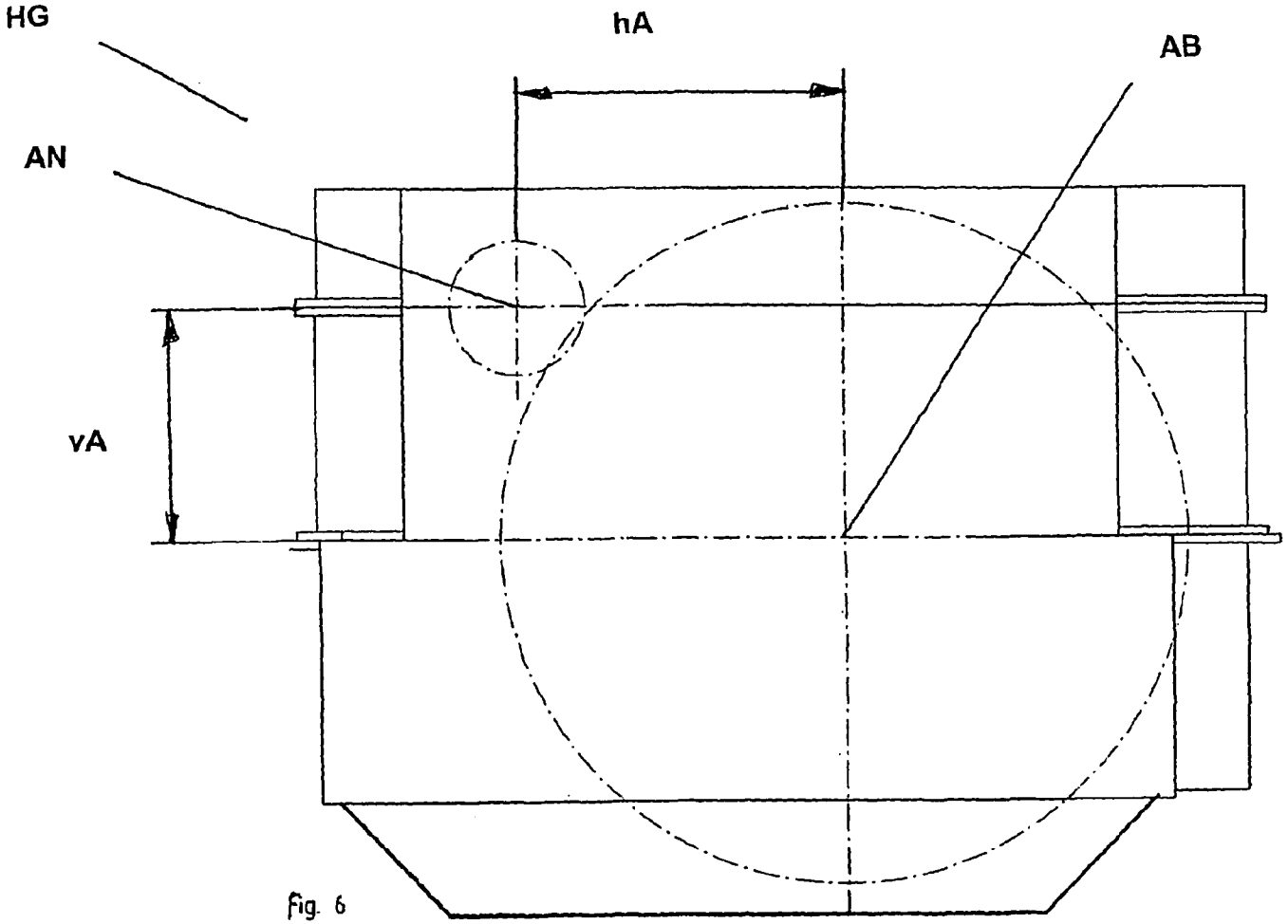
FIG. 6 shows a front elevation of a single-stage main gearbox in accordance with the invention.

The invention is illustrated in FIG. 6. The drive shaft AN and the driven shaft AB of a rolling mill W are separated by both a horizontal distance hA and a vertical distance vA. Starting from an existing foundation, which cannot be structurally changed due to time constraints, the shaft of the drive motor must be adjusted only in the vertical direction.

It is also possible for the main gearbox to have helical gear wheels.

LIST OF REFERENCES SYMBOLS

W rolling mill
M motor
HG main gearbox
AN drive shaft
AB driven shaft
hA horizontal distance from drive shaft to driven shaft
vA vertical distance from drive shaft to driven shaft
KWG pinion gear unit
G mill stand
AW work roll
ZS gear-type spindle
F foundation
ZRK intermediate tube coupling
F foundation

The invention claimed is:

1. A drive arrangement for a rolling mill (W), which consists of at least one drive motor (M), a main gearbox (HG), a pinion gear unit (KWG), a mill stand (G) with work rolls (AW), and the couplings and spindles that connect these components, where, in the main gearbox (HG) an axis of rotation of a drive shaft (AN) and an axis of rotation of a driven shaft (AB) are separated by a horizontal distance (hA), wherein the main gearbox (HG) is designed as a single-stage gearbox, and the drive shaft (AN) is constructed with an upwardly directed vertical distance (vA) from the driven shaft (AB), and the motor (M) is designed connected with a subframe and mounted on a foundation (F).

2. A drive arrangement in accordance with claim 1, wherein the main gearbox has a multistage design (two-stage, three-stage, four-stage).

3. A drive arrangement in accordance with claim 1, wherein the main gearbox (HG) is designed with helical gear wheels.

4. A drive arrangement in accordance with claim 1, wherein the main gearbox (HG) is designed with straight-toothed gear wheels.

* * * * *